United States Patent [19]

Robertson

[11] 4,062,459

[45] Dec. 13, 1977

[54] CONVEYOR FOR HEAT TREATING FURNACE

[75] Inventor: James R. Robertson, Buffalo, N.Y.

[73] Assignee: Harper Electric Furnace Corporation, Lancaster, N.Y.

[21] Appl. No.: 645,570

[22] Filed: Dec. 31, 1975

[51] Int. Cl.[2] ..... F27B 9/38

[52] U.S. Cl. ..... 214/21; 432/239

[58] Field of Search ..... 214/21; 432/239, 235, 432/245; 198/844, 845

[56] References Cited

U.S. PATENT DOCUMENTS

| | | | |
|---|---|---|---|
| 747,887 | 12/1903 | Igelmann | 214/21 X |
| 2,708,107 | 5/1955 | Holcroft et al. | 432/239 |
| 3,331,593 | 7/1967 | Rea | 432/235 |
| 3,374,996 | 3/1968 | Keough | 432/239 X |

*Primary Examiner*—Robert G. Sheridan
*Attorney, Agent, or Firm*—Christel & Bean

[57] ABSTRACT

A conveyor for heat treating furnaces including a plurality of heat insulating elements mounted on a conveyor roller-chain assembly and arranged side-by-side along the conveyor path through the furnace. Articles to be heat treated are supported on the insulating elements for movement by the conveyor through the furnace. The insulating elements are of ceramic fiber heat insulating material of relatively low density and low heat storage capacity. The material of the elements is flexible and has resiliency, and the elements initially are resiliently compressed against each other so as to remain in side-by-side contact even after subsequent heat shrinkage.

10 Claims, 6 Drawing Figures

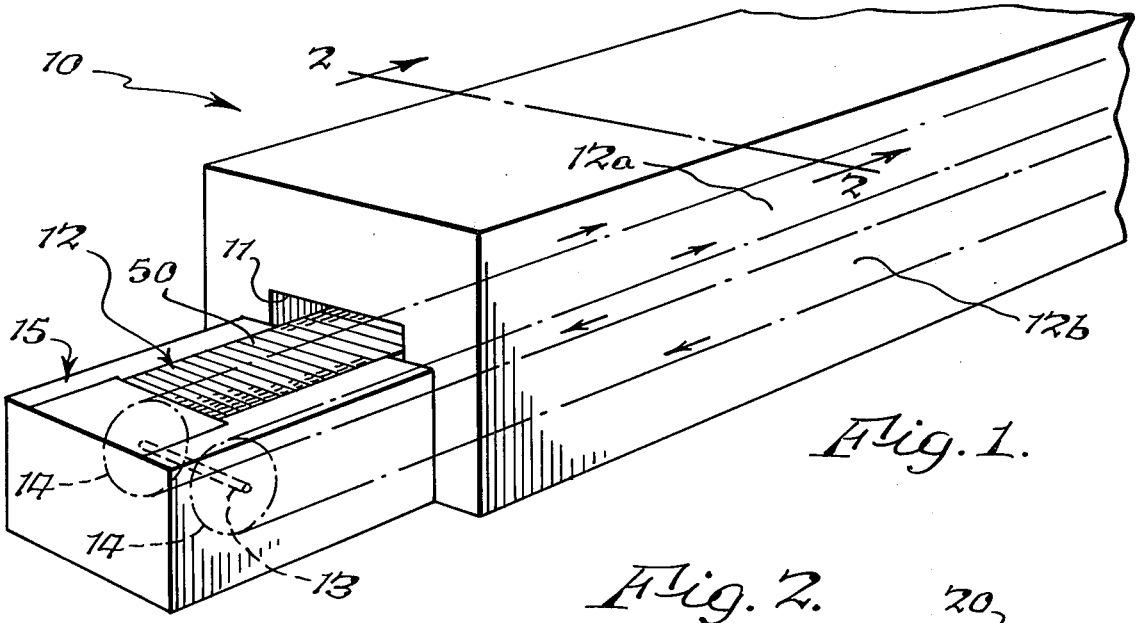
Fig. 1.
Fig. 2.
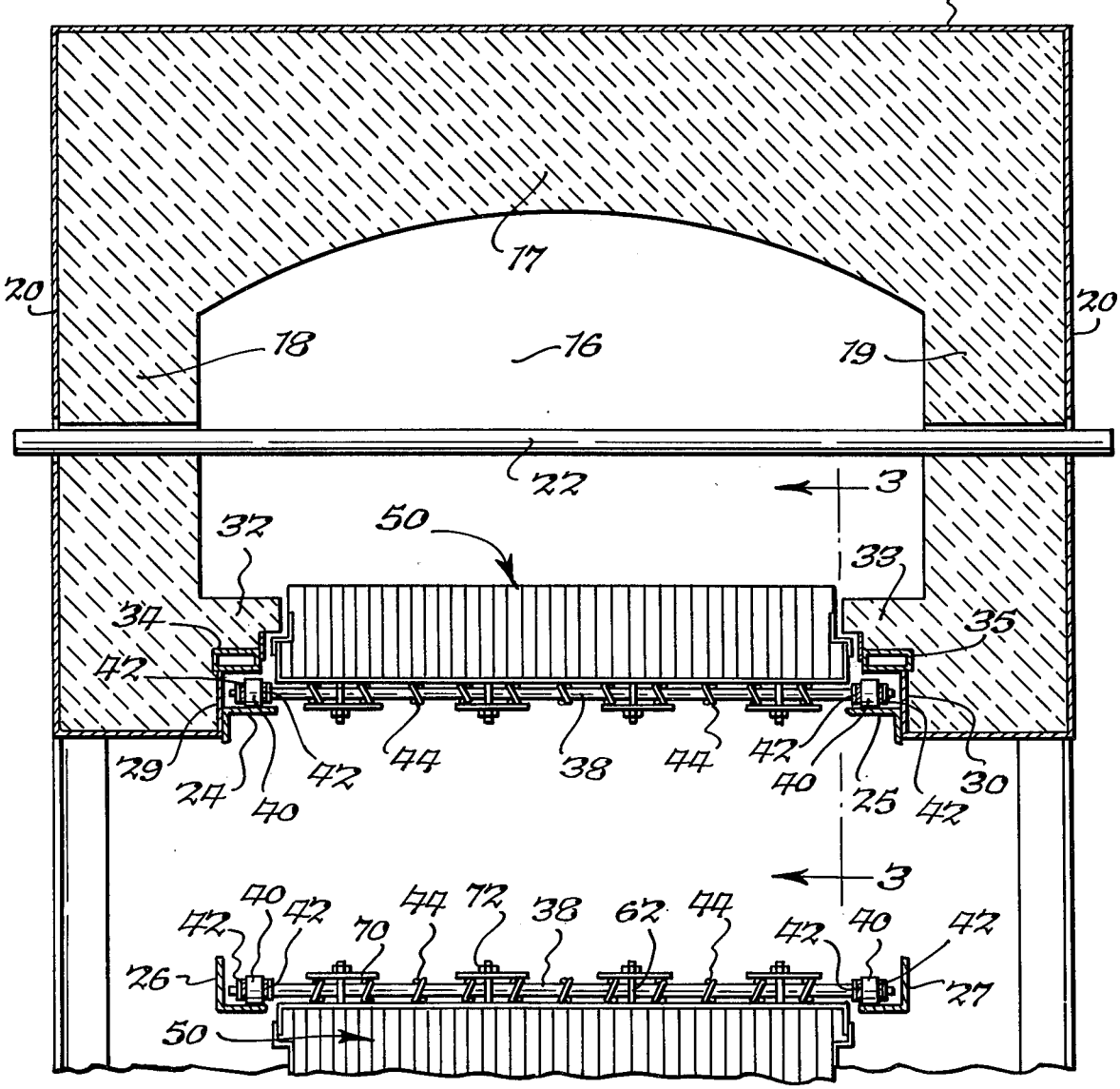

Fig. 3.
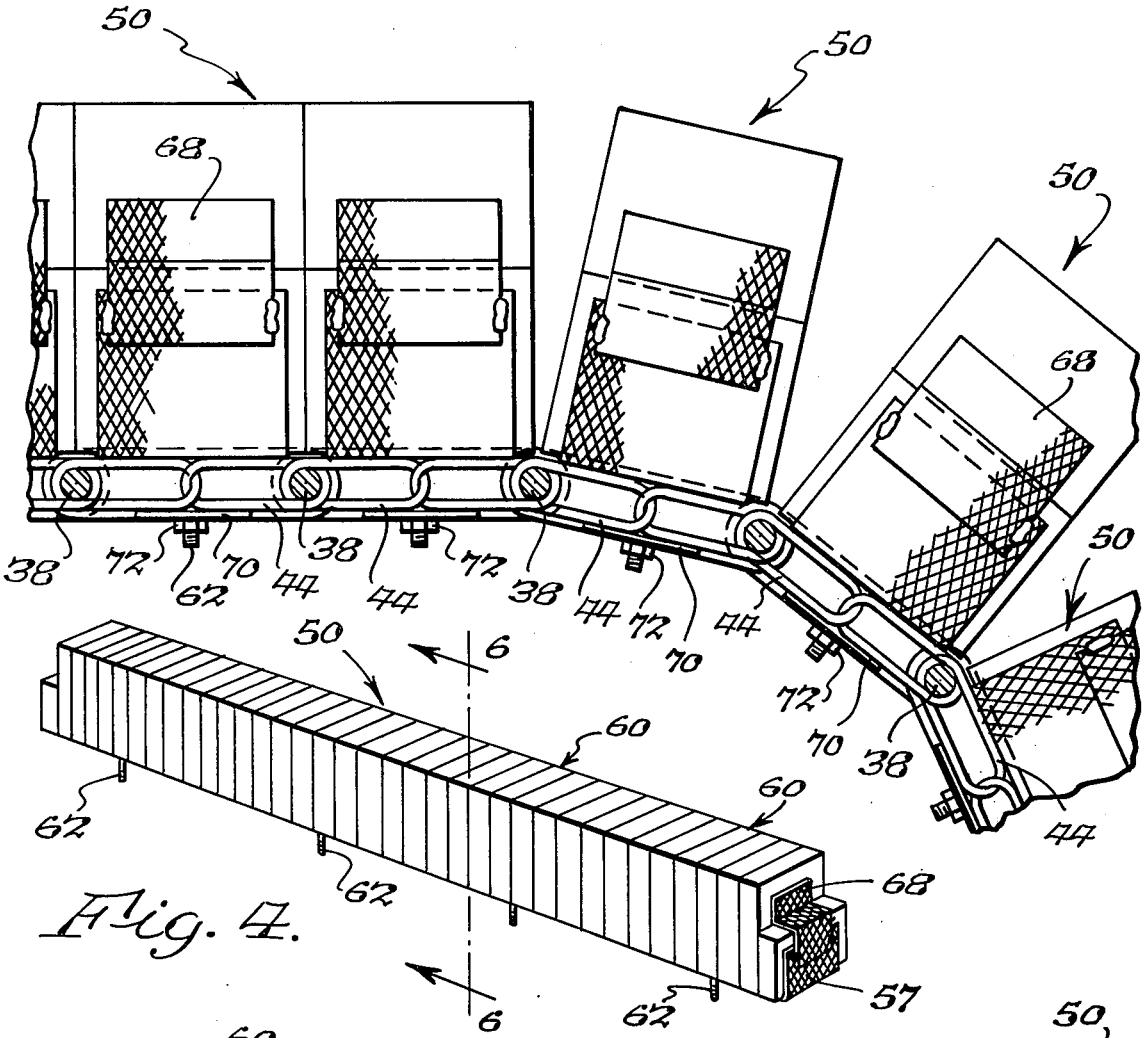
Fig. 4.
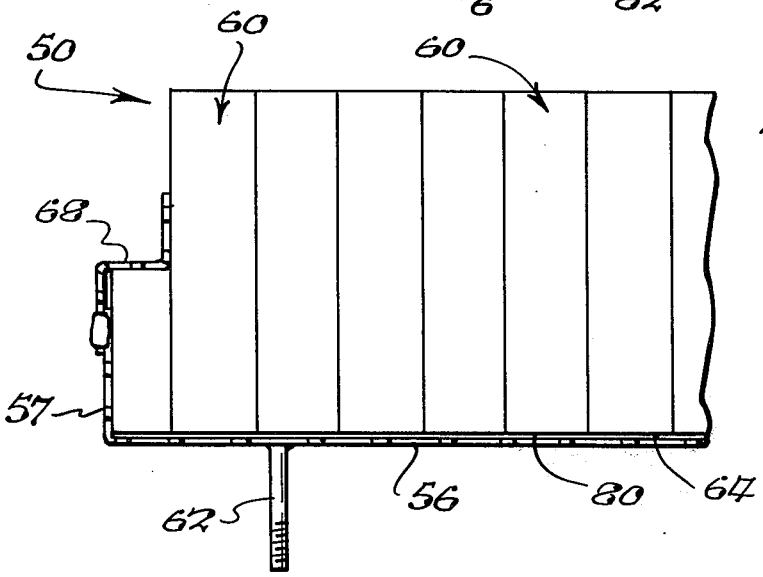
Fig. 5.
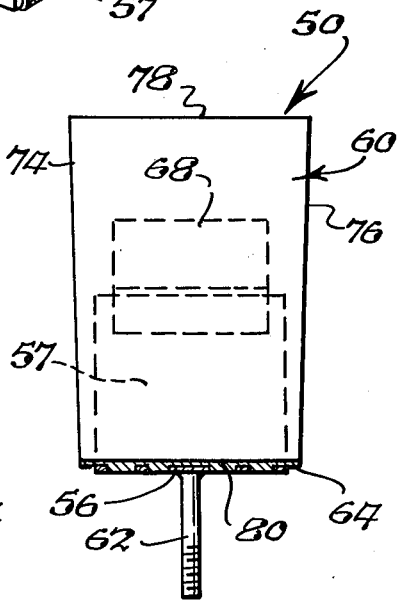
Fig. 6.

CONVEYOR FOR HEAT TREATING FURNACE

BACKGROUND OF THE INVENTION

This invention relates to the art of heat treating furnaces, and more particularly to a new and improved conveyor for moving items through such furnaces.

In heat treating furnaces or kilns various means are employed for moving articles and material through the heating zone, such as wheeled cars moving on rails, pushers for moving material along skid or roller rails, and traveling or driven roll conveyors. The extremely high temperatures encountered in such furnace can cause weakness in the conveyor mechanical parts and adversely affect bearing action. Accordingly, the effects of such high temperatures must be considered in the design and construction of conveyors for furnaces or kilns.

SUMMARY OF THE INVENTION

It is, therefore, an object of this invention to provide a new and improved conveyor for heat treating furnaces and the like.

It is a further object of this invention to provide such a conveyor capable of withstanding the high temperatures encountered in such furnaces.

It is a more particular object of this invention to provide such a conveyor wherein the mechanical components thereof are insulated from direct exposure to the heat of the furnace.

It is a more particular object of this invention to provide such a conveyor wherein the portion thereof directly exposed to the heat of the furnace has low thermal conductivity and low heat storage capacity and yet is low in weight.

It is a further object of this invention to provide such a conveyor which is relatively simple in construction and economical to manufacture and maintain.

The present invention provides a conveyor for heat treating furnaces and the like comprising the drive means and extending along a path in the furnace and a plurality of heat insulating elements of ceramic fiber heat insulating material of relatively low density and low heat storage capacity connected to the support means and arranged side-by-side along the conveyor path. The material of the heat insulating elements is flexible and has resiliency and the elements initially are compressed in side-by-side relation in a manner to compensate for subsequent heat shrinkage so as to remain in side-by-side contact.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 1 is a fragmentary perspective view of a heat treating furnace provided with a conveyor according to the present invention;

FIG. 2 is a fragmentary sectional view taken about on line 2—2 of FIG. 1;

FIG. 3 is a fragmentary elevational view taken about on line 3—3 of FIG. 2;

FIG. 4 is a perspective view of a single heat insulating element of the conveyor of the present invention;

FIG. 5 is an enlarged fragmentary side elevational view of the heat insulating element in FIG. 4; and FIG. 6 is a sectional view taken about on line 6—6 of FIG. 4.

DETAILED DESCRIPTION OF THE ILLUSTRATED EMBODIMENT

Referring now to FIG. 1, there is shown a heat treating furnace or kiln, generally designated 10, through which articles or materials to be heat treated are moved. Furnace 10 is relatively shorter in width and height as compared to the overall length thereof, and a furnace entrance opening 11 at one end is shown in FIG. 1.

A conveyor according to the present invention is generally designated 12 in FIG. 1 for moving articles to be heated through and along the furnace 10. Conveyor 12 includes conventional drive means, for example a drive shaft 13 having sprockets 14 fixed to opposite ends of the shaft and support means including rollers and a belt supported on tracks which will be described in further detail presently which support means is drivenly connected to the drive means and extends along a path in furnace 10, in particular along a path generally parallel to the longitudinal axis of furnace 10. Conveyor 12 is of the continuous or endless belt type including a forward or upper run designated 12*a* in FIG. 1 which moves in the direction indicated by the upper pair of arrows and a return or lower run 12*b* which moves in the direction of the lower set of arrows as viewed in FIG. 1. The conveyor drive shaft is connected to a suitable drive motor (not shown) in a conventional manner, and the entire assembly of drive motor, shaft 13 and sprockets 14 can be housed in an input platform or station assembly 15 where articles or material to be heated are moved or placed onto conveyor 12 to begin the conveyance or travel through furnace inlet 11 and along and through the furnace interior. A similar station or platform can be provided at the exit or outlet opening at the opposite end of the furnace (not shown) for removing the heat treated items.

Furnace 10 can be of various known constructions comprising an elongated hollow furnace body open at the opposite ends. As shown in FIG. 2, an internal heating chamber 16 of furnace 10 is enclosed within a body of refractory material including top 17 and side wall portions 18 and 19 and a floor (not shown), the top or roof portion 17 being slightly curved along the inner surface as shown in FIG. 2. The furnace body preferably is formed of several layers of refractory brick material in a known manner. The outer surfaces of top portion 17, side wall portions 18, 19 and the ends are covered by a shell 20 of metal plates, for example steel to form a rigid support for the brickwork. The heating chamber 16 may be heated in any suitable manner, and in the present illustration chamber 16 is heated by rod-shaped electrical resistors, one of which is shown at 22, to which electricity is conducted and the resistance of which causes heat to be generated in the heating chamber 16. Typically, furnace 10 operates at temperatures in a range from about 2100° F to about 2400° F in chamber 16. Alternatively, the chamber can be heated by gas burners. In any event, heat is supplied and radiated from generally the upper portion of the furnace as viewed in the drawings in a direction toward the conveyor 12 on which the material and articles to be heated are supported and carried through and along the heating chamber 16. By way of illustration, furnace 10 is used to fire coatings applied to articles and to heat crystals and ferramagnetic articles to vary their physical and electrical characteristics.

A conveyor path in furnace 10 is defined by means including a pair of spaced apart parallel rails or tracks 24, 25 defining the upper or forward run of conveyor 12 and a pair of spaced apart parallel rails or tracks 26, 27 defining the return or lower run of the conveyor. In the present illustration each of the rail members is L-shaped in cross section with one leg disposed generally horizontally to support the conveyor and the other leg being secured to an inner surface of the corresponding furnace wall. In particular, rails 24, 25 are secured to corresponding metal structural elements 29 and 30 as shown in FIG. 2 which, in turn, are fixed to corresponding inner surfaces of the furnace walls. Similarly, rails 26 and 27 are fixed to the interior of the furnace structure in a suitable manner. In the present illustration, the furnace walls include inwardly projecting or extending portions 32, 33 below which are located structural members 34, 35 which, in turn, are located above the metal elements 29, 30. A space thus is provided between rails 24, 25 and the structural members 34, 35.

The conveyor according to the present invention comprises supporting means in the form of a plurality of rods or shaft-like elements 38 and a pair of roller elements 40 rotatably connected on each rod 38, there being one roller at each end of a rod 38. Each rod 38 is of sufficient length and the rollers 40 are positioned adjecent the ends such that rollers 40 are supported on the horizontal surface of the rails 24, 25 as shown in FIG. 2. Conveyor 12 includes a plurality of shaft elements 38 and corresponding rollers 40 along the entire operative length thereof as shown in FIGS. 2 and 3. This of course includes the lower or return run of the conveyor as shown in FIG. 2 where the rods 38 and rollers 40 likewise are supported on the horizontal portions of the rails 26, 27. Adjacent rod and roller assemblies are interconnected in a conventional manner by link elements designated 42 in FIG. 2. The links can be of any suitable length depending upon the spacing desired between the adjacent rod elements 38. The interconnected rollers and links comprise a standard roller chain conveyor arrangement which chains are trained around the sprockets of the conveyor drive means at each end of the conveyor in a known manner. A conveyor belt or fabric also is provided and is of a wire mesh-like construction with the fabric wire loops or structural components being designated 44 in FIGS. 2 and 3. In the present illustration, two lateral rows or series of loop elements 44 are joined together and in turn serve to connect two rods 38. Other arrangements can of course be employed with a larger number of rows of loop elements between adjacent rods or with only one roll or series of elements 44 joining adjacent rods 38. In addition, while a wire mesh or fabric type belt construction is shown, other conveyor belt arrangements including solid belts can of course be employed.

The conveyor according to the present invention further comprises a plurality of heat insulating elements, each of which is designated 50 in FIGS. 1–3, which are arranged side-by-side along the conveyor path. Each of the insulating elements 50 is of ceramic fiber heat insulating material of relatively low density and low heat storage capacity. The elements 50 are in side-by-side contact and are included along the entire length of the conveyor path the arrangement of elements 50 being of a width substantially equal to the width of the conveyor provide to a heat insulating barrier for the remainder of the conveyor components. The articles to be heated in the furnace are placed on the series of adjacent elements 50 at the loading station 15 shown in FIG. 1, and the articles remain on the elements 50 as the conveyor moves or transports them through the furnace.

Each of the heat insulating elements 50 comprises a body of ceramic fiber heat insulating material. The material has a relatively low thermal conductivity with the result that the series of elements 50 provides a highly effective heat insulating barrier to protect the conveyor mechanical components such as rods 38, rollers 40, links 42 and the belt formed by the loop elements 44 from the intense heat supplied from the upper region of furnace chamber 16. This, in turn, enhances the efficiency and effectiveness of operation of conveyor 12 and prolongs its wear life.

The ceramic fiber material has relatively low density, a workable density being in the range of from about 2 pounds per cubic foot to about 20 pounds per cubic foot with a density of about 6 pounds per cubic foot for the ceramic fiber material having demonstrated satisfactory and effective results. The relatively low density of the material of elements 50 results in the desirable heat insulating properties described above being provided in a conveyor of relatively low overall weight thereby giving rise to economics of construction and operation.

Related to the relatively low density of the material of heat insulating elements 50 is the relatively low heat storage capacity. This is of particular advantage in cyclic operations because due to the low heat storage capacity the material is subjected to relatively little heat shock. This, in turn, enables heat up and cooldown to be faster and increases the number of heats which can be run each day. In addition, the low heat storage of the material results in less furnace heat being taken up by the material which, in turn, requires less furnace fuel for heat-ups and cooldowns.

The material of elements 50 has flexibility and resiliency, and these properties are utilized according to the present invention to provide an effective heat insulating barrier in a manner which will be described in detail presently.

A preferred ceramic fiber material is commercially available under the designation Kaowool 2600 and Kaowool 3000, the term Kaowool being a registered trademark of the Babcock & Wilcox Company. The numbers 2600 and 3000 designate the maximum heat processing temperatures in degrees Fahrenheit for which the material is suited. The raw material is kaolin, a naturally occurring, high purity alumina-silica fireclay. The fibers in the material have average lengths of about four inches and are interlaced in the production process to provide strength. The composition of the material is approximately 45.1% by weight alumina and approximately 51.9% silica by weight. Typical densities range from about 2 pounds per cubic foot to about 8 pounds per cubic foot. Other varieties of ceramic fiber material having the foregoing characteristics and properties can be employed.

FIGS. 4–6 illustrated in further detail the construction of a single one of the heat insulating elements 50 and means for mounting the same to the conveyor supporting means. The mounting means includes an elongated metal frame element preferably formed of mild steel grid or mesh and having a generally planar base portion 56 and a pair of flange portions extending in the same direction from the base and each flange being disposed at about a right angle to the plane of base portion 56, there being one flange such as flange 57 at each end of base 56. The ceramic fiber material is in the form of a plurality of block-like planar elements of identical size and shape which are fitted face-to-face within the frame so as to provide a laminated construction as shown in FIGS. 4 and 5, the individual blocks or components each being designated 60. Thus, in the present illustration the plurality of solid rectangular blocks 60 of ceramic fiber material are held together in the mounting frame to provide a body of the material constituting a single heat insulating element 50. An illustrative method of forming each element 50 is as follows: The frame placed on a flat surface on top of a piece of wax paper or similar material with the flanges disposed upwardly. A series of stud elements 62 are welded or otherwise fixed at spaced locations to the frame base portion 56 as illustrated in FIGS. 4 and 5, the studs extending perpendicular to the other surface of base 56 relative to the flanges with the threaded portions of the studs exposed for connection. A cement material 64 of suitable type, capable of withstanding the high temperatures within furnace 10, is applied to the base 56 so as to flow between the grids thereof and provide a coating thereon whereupon the individual blocks 60 of the ceramic fiber material then are fitted to the frame in side-by-side relation with one edge surface contacting cement 64. Cement 64 can be commercially available refractory types or the equivalent. As illustrated in FIG. 4, one block at each end of the assembly is somewhat smaller along one dimension, and a pair of bracket elements, one of which is designated 68, are welded or otherwise secured at the ends of the frame assembly to the corresponding flanges, such as flange 57, to hold the blocks further in place. The bracket elements 68 are of a suitable heat resistant metal alloy, one typical example being an alloy containing by weight approximately 35% nickel, 19% chrome, 1.25% silicon and the remainder iron. Each bracket is of a shape including a planar central portion and two legs extending in opposite directions and at right angles to the plane of the central portion. Thus a shoulder is provided at each end of the completed element 50 for a purpose to be described. Each completed heat insulating element 50 then can be mounted or fixed on the conveyor support, for example by placing it on the upper or exposed surface of the wire mesh or fabric so that the studs 62 extend through the plane of the loop elements. Then small plate elements designated 70 in FIG. 3 each having an aperture are positioned onto each stud and against the opposite surface of the mesh and held in place by a nut 72 threaded onto the bolt. The foregoing procedure is repeated for all of the heat insulating elements 50 which are connected to the conveyor supporting means in side-by-side contact along the entire length of the conveyor path.

By way of illustration, a heat insulating element 50 of the present invention for a typical conveyor application comprises thirty four elements 60 each having a thickness of about one inch measured parallel to the longitudinal axis of the element 50. The two end elements 60 also each have a thickness of about one inch to provide an overall length of about 36 inches for each element 50. The dimension of each element 60 in a direction perpendicular to the frame base portion 56 of a completed assembly is about 6½ inches. This dimension is the same in all of the heat insulating elements 50 so that the exposed or outer surfaces thereof define a relatively smooth and uniform supporting surface along the conveyor path for supporting articles thereon. The particular value of this dimension may be changed for different types of conveyors because it is determined by, among other things, available clearances around the sprockets at each end of the conveyor and the amount of heat insulation required against heat rays travelling in a direction normal to the conveyor path.

The ceramic fiber material of the heat insulating elements 50 is of a flexible and resilient nature. The resiliency of the material is utilized according to the present invention to compensate for any shrinkage of the elements 50 upon exposure to the intense heat of the furnace thereby insuring that the elements maintain an effective heat insulating protective barrier for the conveyor components. In accordance with the present invention, the elements 50 are resiliently compressed together in side-by-side relation when assembled in the conveyor. The degree of compression is sufficient so that upon subsequent shrinkage of elements 50 they will remain in side-by-side contact or abutting relation thereby maintaining the insulating barrier. In other words, the shrinkage will not result in spaces between adjacent elements 50 which otherwise would allow passage of heat to the conveyor components in the region adjacent the surfaces of elements 50 not directly exposed to the heat.

Referring to FIG. 6, the foregoing is accomplished by having a width of each element 50 along the outer or hot surface 78 slightly greater than the width along the inner or cold face 80. By way of illustration, in the foregoing exemplary conveyor where the overall length of the elements 50 is about 36 inches, the dimension of surface 78 measured between side surfaces 74, 76 is 4⅛ inches and the dimension of surface 80 measured between sides 74, 76 is 4 1/16 inches. The compression provided by this dimensional difference of 1/16 inch has been found to provide satisfactory results in situations including the foregoing operating temperatures and characteristics of ceramic fiber material. This, when elements 50 are mounted on the conveyor assembly with the portions adjacent the inner surfaces 80 in contact, the portions adjacent the outer surfaces 78 are resiliently compressed together. Upon shrinkage of the portion of each element 50 due to heat, the initial resilient compression is sufficient to compensate for such shrinkage so that the side faces 74, 76 of adjacent elements 50 remain in contact. The portion of each element 50 adjacent and including outer face 78 may lose some or all the resiliency upon exposure to the intense heat, but the remainder of each element remains resilient.

In operation, conveyor 12 moves along an endless path including the forward **12*a* and return 12*b* runs under the influence of the drive means to convey or transport items to be heated along and through furnace 10. The heat insulating elements 50 of the conveyor support the articles being heat treated and provide a solid lightweight heat insulating barrier between the oven chamber 16 and the conveyor mechanism. Typical loads supported by the arrangement of elements 50 are in the neighborhood of up to about fifty pounds per square foot. The individual elements 50 are mounted sufficiently close together to be somewhat compressed against each other in the direction of movement along the conveyor path. The initial compressing together of adjacent elements 50 accomodates shrinkage thereof due to the intense heat of furnace 10, thereby preventing opening or separating of adjacent elements for heat to directly radiate through. The individual heat insulating elements 50 do separate angularly around the sprockets at each end of the conveyor 12, but this is generally at a location exterior to the heating chamber 16 and in any event not directly exposed to the main source of heat in the furnace. The elements 50 are of a length so as to cover the entire operative width of the conveyor path. The shouldered structure at each end of the elements 50 cooperates with the corresponding shouldered furnace wall portions 32, 38** whereby there is no direct exposure of the conveyor mechanism to heat radiating from the furnace. The construction of the conveyor of the present invention is relatively simple in construction and economical to manufacture and maintain.

It is therefore apparent that the present invention accomplishes its intended objects. While a single embodiment of the present invention has been described in detail, this is done for purpose of illustration, not limitation.

I claim:

1. In a heat treating furnace, a conveyor for moving articles to be heated through said furnace, said conveyor comprising:

a. drive means;

b. means defining a conveyor path in said furnace;

c. support means drivenly connected to said drive means and extending along said path in said furnace for movement along said path;

d. a plurality of heat insulating elements connected to said support means and arranged side-by-side along said path, each of said insulating elements being of flexible ceramic fiber heat insulating material of relatively low density and low heat storage capacity to provide a heat insulating barrier for said conveyor support means and;

e. each of said heat insulating elements extending across the entire width of said conveyor and each element being formed with a shoulder at each end thereof, there being a shoulder structure in said furnace adjacent said conveyor path defining means for cooperation with said shoulders of said heat insulating elements to prevent direct exposure of portions of said conveyor inwardly of said shoulders to the heat of said furnace.

2. In a heat treating furnace, a conveyor for moving articles to be heated through said furnaces, said conveyor comprising:

a. drive means;

b. means defining a conveyor path in said furnace;

c. support means drivenly connected to said drive means and extending along said path in said furnace for movement along said path; and d. a plurality of heat insulating elements connected to said support means and arranged side-by-side along said path, each of said insulating elements being of ceramic fiber heat insulating material of relatively low density and low heat storage capacity, the material of said heat insulating material having resiliency, said elements being arranged initially resiliently compressed together, the degree of compression being sufficient so that upon shrinkage of said elements when exposed to the heat of said furnace, said elements remain in side-by-side contact so as to maintain a heat barrier for said conveyor.

3. A conveyor according to claim 2, wherein the material of said heat insulating elements has a density in a range from about 2 pounds per cubic foot to about 20 pounds per cubic foot.

4. A conveyor according to claim 2, wherein said plurality of heat insulating elements is provided along the entire length of said conveyor.

5. A conveyor according to claim 2, wherein said heat insulating elements are of generally uniform dimension in a direction generally normal to the plane of the conveyor path whereby a generally smooth planar surface is provided by said elements for supporting articles being conveyed through said furnace.

6. A conveyor according to claim 2, further including relatively rigid frame means for connecting said heat insulating elements to said conveyor support means, said frame means being mounted to said conveyor support means and each of said heat insulating elements being held by a corresponding frame means.

7. A conveyor according to claim 2, wherein each of said heat insulating elements is elongated and disposed on said support means with the longitudinal axis thereof generally perpendicular to the direction of said conveyor path.

8. A conveyor according to claim 2, wherein said conveyor path includes spaced-apart generally parallel forward and return conveyor runs, the opposite ends of said conveyor where said forward and return runs are joined being located exteriorly of said furnace for loading and unloading articles.

9. In a heat treating furnace, a conveyor for moving articles to be heated through said furnaces, said conveyor comprising;

a. drive means;

b. means defining a conveyor path in said furnace;

c. support means drivenly connected to said drive means and extending along said path in said furnace for movement along said path; and d. a plurality of heat insulating elements connected to said support means and arranged side-by-side along said path, each of said insulating elements being of ceramic fiber heat insulating material of relatively low density and low heat storage capacity, the material of said heat insulating elements having resiliency and each of said heat insulating elements having an inner surface adjacent said support means and an outer surface spaced from said inner surface and exposed to the heat of said furnace, the dimension of said outer surface measured in a direction along said conveyor path being slightly greater than the corresponding dimension along said inner surface, said elements being connected to said support means in a manner such that adjacent elements are initially resiliently compressed to compensate for shrinkage due to heat of said furnace to maintain adjacent ones of said elements in contact.

10. In a heat treating furnace, a conveyor for moving articles to be heated through said furnace, said conveyor comprising:

a. drive means;

b. means defining a conveyor path in said furnace;

c. support means drivenly connected to said drive means and extending along said path in said furnace for movement along said path;

d. a plurality of heat insulating elements connected said support means and arranged side-by-side along said path, each of said insulating elements being of flexible ceramic fiber heat insulating material of relatively low density and low heat storage capacity to provide a heat insulating barrier for said conveyor support means;

e. relatively rigid frame means for connecting said heat insulating elements to said conveyor support means, said frame means being mounted to said conveyor support means and each of said heat insulating elements being held by a corresponding frame means; and f. each frame means having a base portion and a pair of spaced-apart generally parallel flanges extending from said base and each heat insulating element being of laminated construction and held in the frame means with the laminations thereof disposed generally parallel to said frame flanges.

* * * * *